United States Patent [19]

Reeves, Jr.

[11] Patent Number: 4,722,641

[45] Date of Patent: Feb. 2, 1988

[54] METHOD AND MEANS FOR EFFECTING DISCHARGE OF DRY BULK MATERIAL FROM HOPPER-TYPE VESSEL

[75] Inventor: William M. Reeves, Jr., Sulther, La.

[73] Assignee: PPG Industries, Inc., Pittsburgh, Pa.

[21] Appl. No.: 937,254

[22] Filed: Dec. 3, 1986

[51] Int. Cl.[4] ..... B65G 53/38

[52] U.S. Cl. ..... 406/137; 406/88; 406/95

[58] Field of Search ..... 406/137, 136, 138, 123, 406/145, 191, 95, 86, 88; 222/195

[56] References Cited

U.S. PATENT DOCUMENTS

| | | | |
|---|---|---|---|
| 713,787 | 11/1902 | McKone | 406/95 |
| 3,253,865 | 5/1966 | Kanics | 406/86 |
| 3,343,886 | 9/1967 | Kemp et al. | 406/138 X |
| 3,366,282 | 1/1968 | Lucas | 406/137 X |
| 3,558,195 | 1/1971 | Kanics | 406/95 |
| 3,583,768 | 6/1971 | Koranda | 406/138 X |
| 4,220,425 | 9/1980 | Jacobson | 406/95 X |

FOREIGN PATENT DOCUMENTS

| | | | |
|---|---|---|---|
| 1049374 | 11/1966 | United Kingdom | 406/137 |

*Primary Examiner*—Joseph F. Peters, Jr.
*Assistant Examiner*—James M. Kannofsky
*Attorney, Agent, or Firm*—Irwin M. Stein

[57] ABSTRACT

Describes a device for facilitating the removal of pulverulent material from a hopper-type vessel and a method utilizing the device. The device comprises an elongated hollow member closed at one end, which is adapted for insertion into the discharge channel below the hopper. The device contains an orifice for selectively directing the flow of a gas, e.g., air, in the direction of the opening in the bottom of the hopper and apparatus for introducing pressurized gas into the discharge channel.

16 Claims, 3 Drawing Figures

METHOD AND MEANS FOR EFFECTING DISCHARGE OF DRY BULK MATERIAL FROM HOPPER-TYPE VESSEL

DESCRIPTION OF THE INVENTION

The present invention relates to a method and means for assisting in or otherwise facilitating the removal of finely divided, dry pulverulent material from vessels containing same and particularly relates to the removal of dry bulk material from hopper-type vessels such as railway hopper cars.

It is common practice to transport various granular and/or powdery materials (both organic and inorganic) in bulk such as in railway, automotive or shipboard containers. Typical of such containers are hopper-type railway and automotive hopper cars. As will be appreciated by those skilled in the art, many of such materials tend to bridge across or "hang up" at the discharge opening of the generally conically shaped hoppers of the transport vessel.

In order to assist the discharge of dry bulk material from material transfer vessels, it has been proposed to utilize aerators of various designs which discharge air under pressure within the interior of the transfer vessel. Such systems have ordinarily required a substantial amount of permanently-installed piping either within or attached to the exterior of the vessel. Some transfer vessels are not equipped with auxiliary aerating equipment. Consequently, there is a need for methods and means for effecting the discharge of dry bulk pulverulent material from such transfer vessels, particularly a hopper-type vessel, which are used commonly to transfer pulverulent materials that remain relatively free-flowing during shipment, but which tend to bridge at the discharge opening of the vessel during unloading.

The present invention consists of certain novel features of construction, arrangement and combination of parts, as hereinafter fully described and/or illustrated in the accompanying drawings and description, and as more particularly pointed out in the appended claims. For the purpose of facilitating and understanding the invention, there is illustrated in the accompanying drawings preferred embodiments of the invention. While one form of the invention is described in considerable detail in connection with the drawings, it will be understood by those skilled in the art that numerous modifications and variations in the invention may be made. The aforesaid preferred embodiments are intended as illustrative only.

BRIEF DESCRIPTION OF THE DRAWINGS

The invention may be more fully understood by reference to the accompanying drawings, wherein like reference numbers refer to like parts, in which.

DETAILED DESCRIPTION OF THE INVENTION

Figure 1:
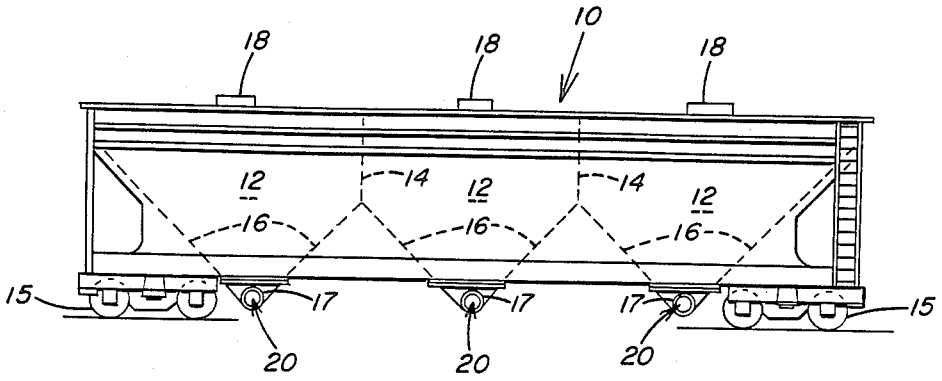
FIG. 1 is a side elevation view of a railway car having a plurality of hoppers, each hopper having a lateral discharge conduit located at the bottom thereof.

Referring to FIG. 1, there is shown a typical hopper-type railroad hopper car 10. The hopper car is provided with a suitable support structure and undercarriage or wheel assembly 15. The car contains a plurality of generally conically shaped hoppers 12, each of which may be unloaded separately. Each of the hoppers 12 are defined by plate members 14 and sloping sheets 16 that are welded or otherwise suitably secured to the internal surface of the hopper car shell such that the bottom of the hoppers resemble an inverted cone or trapezoid section. The tapered bottom of the hopper usually leads to an elongated lateral discharge opening (not shown), which extends across the bottom of the hopper and which openly communicates with an elongated lateral discharge conduit or channel 17 directly below and substantially parallel to the discharge opening in the bottom of the hopper. Both the discharge opening in the bottom of the hopper and the lateral discharge channel are essentially perpendicular to the longitudinal axis of the railroad car. The discharge opening in the bottom of the hopper is generally provided with a valve, e.g., a rotating gate valva, which regulates the gravitational flow of material from the hopper through the discharge opening to the discharge channel 17. Discharge charnel 17 has an open inlet end and an open discharge end. In practice, both ends of channel 17 are covered by easily removable caps during loading and transport. The inlet and discharge ends are substantially identical and may be used interchangeably, depending on the positioning of the railroad car for unloading. As shown in FIG. 1, the ends of channel 17 are circular and may be provided with circular extensions or necked portions over which may be fitted the aforementioned conventional caps as is known to the skilled artisan. Each of the hoppers has a covered opening or port 18 for filling the hopper with dry pulverulent free-flowing material.

Figure 3:
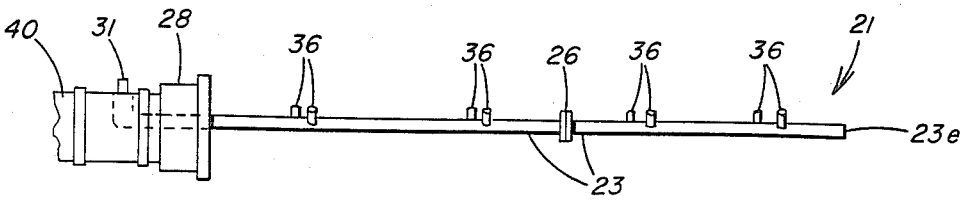
FIG. 3 is a side view of a further embodiment of the present invention.

Referring to FIG. 3, there is shown a side view of an embodiment of the present invention. Depicted in FIG. 3 is aerator tool 21, which comprises segmented elongated hollow member means 23 which is closed at its distal end 23*e*, open at its inlet end, and is sized and otherwise adapted for insertion into the inlet end of channel 17. Hollow member 23 contains a plurality of orifice means, such as nozzles 36, for selectively directing the flow of a pressurized gaseous fluid, e.g., air, in the direction of the lateral discharge opening to fluidize or otherwise break-up a bridge of material that forms in the discharge opening. While eight orifices are shown protruding from member 23, more or less may be used. The number of orifices required will depend on the size of the hopper, e.g., the length of the lateral discharge opening, and the amount of air pressure required to provide sufficient gas flow to prevent bridging of pulverulent material across the lateral discharge opening.

The near or inlet end of member 23 passes through and is attached to hollow attachment means 28 near its center. Attachment means 28 is adjacent to the inlet end of member 23 and may comprise collar or suitable housing means for holding member 23 and for connection to the inlet end of channel 17. Attachment means 28 and the outer wall of member 23 define an annular opening or space in attachment means 28 through which gas may pass. The annular space is essentially coaxial with the longitudinal axis of member 23. Flexible fluid gas line means 40 is connected to attachment means 28 and line 40 is in turn connected to a source of pressurized gas (not shown). The pressurized gas flowing through line 40 is directed through the annular space in attachment means 28 around hollow member 23 and through discharge channel 17 toward the discharge end of said channel.

The inlet or near end of member 23 is connected by suitable male connecting means, e.g., nipple 31, to a fluid gas line separate from gas line 40 which, in turn, is connected to a source of pressurized gas. Typically, the source of pressurized gas for gas line 40 and member 23 will be the same, i.e., a common compressor or source of compressed gas, e.g., compressed air, available from the plant receiving the bulk pulverulent cargo; but, the gas lines connecting the source of the pressurized gas to member 23 and gas line 40 are preferably separate.

Member 23 is sized to permit its easy insertion into channel 17 and to permit also the ready flow of material from the hopper into the discharge channel. Preferably, member 23 has a relatively small cross-section, vis a vis the diameter or size of channel 17, i.e., the outer wall or dimension of member 23 is spaced from the inner wall or boundary of channel 17 to allow the flow of material into the discharge channel from the hopper and subsequently out of the discharge channel. Fitting 26 in member 23 permits one segment of the member to be rotated around its longitudinal axis with respect to the other segment. Each segment has a length that conveniently may be about equal to one-half the length of the lateral discharge opening; however, the segment lengths may be unequal.

In practice, member 23 is inserted into the inlet end of discharge channel 17 with the orifices therein facirg upwardly toward the lateral discharge opening in the bottom of hopper 12 and in the direction of the downwardly falling pulverulent material. Attachment means 28 is adapted to fit snugly over the exposed inlet neck of channel 17. A gasket around the inlet neck may be used to obtain a secure and tight fit. Pressurized fluid gas lines are connected to the inlet end of member 23, i.e., to nipple 31, and to attachment means 28, i.e., by flexible gas line 40. The flow of pressurized gas is started through member 23, through the annular opening in attachment means 28 and thence through discharge channel 17. The lateral discharge opening in the bottom of hopper 12 is then opened to permit pulverulent material to fall by gravity into channel 17. Pressurized air flowing through channel 17 from gas line 40 serves as a carrier gas to suspend pulverulent material and transport it out of discharge channel 17 into a discharge line leading usually to a storage facility for the material.

Figure 2:
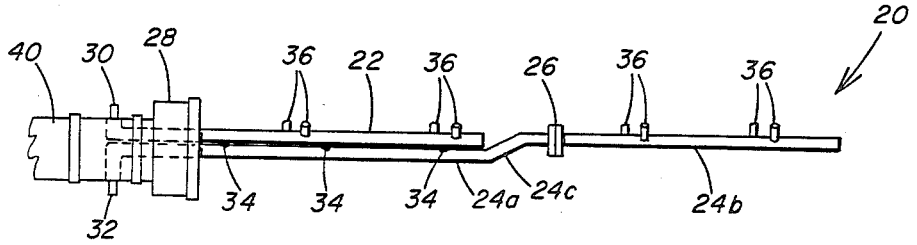
FIG. 2 is a side view of an embodiment of a tool of the present invention which may be inserted into the lateral discharge conduit of a hopper illustrated in FIG. 1.

Referring to FIG. 2, wherein like reference numbers refer to like parts, there is shown a preferred embodiment of the aerator tool of the present invention. This tool 20 comprises a first elongated tubular hollow member 22 which is closed at its distal end, i.e., the end furthest away from the source of air pressure, and which contains a plurality of orifices, e.g., nozzles 36. The near or inlet end of tubular member 22 terminates in connector means, e.g., nipple 30, for connection to a fluid gas supply line which in turn is connected to a source of pressurized air (not shown). The length of member 22 may be approximately one-half of the length of the elongated lateral discharge opening across the bottom of hopper 12, i.e., from attachment means 28 to about the middle of the lateral discharge opening. While four nozzles are illustrated on member 22, the number of orifices or nozzles may vary and, as stated, will depend on the width of the hopper-type vessel and the amount of air pressure required to assist in the discharge of the dry material from the hopper.

Member 22 is juxtaposed to segmented elongated hollow tubular member 24 which itself comprises three sections. The first section of member 24, i.e., section **24*a*, has a longitudinal axis parallel to member 22 and is slightly longer than member 22. The other horizontal section of member 24, i.e, section 24*b*, has a longitudinal axis that is coincident (coaxial) with the longitudinal axis of member 22 when both members 22 and 24 are fully extended and rigidly held. Obviously, because of its length, member 24 will tend to bend and flex when unsupported. Connecting sections 24*a* and 24*b* is angled section 24*c*. Members 22 and 24 are illustrated as tubular hollow members having outer walls. The outer wall of member 22 and the outer wall of the first section of member 24, i.e, section 24*a*, may be rigidly affixed, i.e., held together, by connection means, e.g., spot welds 34. Attachment means 28 is adjacent to the inlet ends of members 22 and 24**.

The total length of member 24 is preferably approximately equal to the length of the discharge opening in hopper 12. The length of section **24*a* of member 24 may extend from attachment means 28 to about the middle of the lateral discharge opening; whereas the length of section 24*b* of member 24 may extend from about the terminal end of section 24*a* to about the distal end of the lateral discharge opening. As with respect to member 23, the relative lengths of members 22 and 24 that contain orifices may vary and may be unequal. Section 24*b* also contains a plurality of orifices or nozzles 36. Thus, when tool 20 is placed into use within discharge channel 17, the effective length of tool 20 will be approximately the entire length of the lateral discbarge opening in hopper 12. As discussed with respect to member 22, the distal end of member 24 is closed and the near or inlet end of member 24 terminates in connector means, e.g., nipple 32, for connection to a gas line and source of pressurized gas not shown. Fitting 26 is provided in member 24, e.g, near the abutment of sections 24*b* and 24*c*, to allow section 24*b* of member 24** to be rotated around its longitudinal axis in the event that one section of the valve controlling the flow of bulk material from the hopper through the lateral discharge opening (or the opening itself) is offset from another section.

Nozzles 36 are shown offset from the vertical; but, may be on the same vertical plane. Typically, nozzles 36 may be offset from the vertical up to about 45°. Thus, the included angle between two adjacent nozzles may vary from 0° to 90°. Preferably, the included angle between two adjacent nozzles is about 60°, i.e., each jet is displaced from the vertical about 30°. Members 22 and 24 pass through and are attached, e.g., at about the center, to attachment means 28, which, as described with respect to FIG. 3, is adapted to fit snugly over an extension, e.g., circular necked portion, of discharge channel 17. Members 22 and 24 define with hollow attachment means 28 an annular substantially coaxial space or opening in attachment means 28 through which pressurized gas may pass.

In unloading bulk material from a hopper-type vessel, pneumatic gas pressure can be used as a carrier gas to carry material that has fallen from the hopper into the discharge channel by gravity into a discharge line (not shown) which is connected to the open discharge end of discharge channel 17, which discharge line may lead to a storage vessel. Alternatively, a vacuum can be drawn on the discharge end of discharge channel 17 and material drawn into the storage vessel utilizing the higher atmospheric pressure exerted on the pulverulent material contained within the hopper. In accordance with the embodiment of FIG. 2, pressurized gas is passed through the annular space defined by attachment means 28 and members 22 and 24 to transport pulverulent material falling through the lateral discharge opening in the bottom of the hopper into the discharge channel toward the discharge end of channel 17 to a product discharge line (not shown). Flexible gas line 40, which is connected to a source of pressurized gas, brings the fluid gas to the annular space.

In operation of the method of the present invention, with the tool of FIG. 2, aerator tool 20, is inserted into discharge channel 17 and affixed to the exposed neck of the inlet end thereof by attachment means 28. Typically, a gasket is placed over the end of the exposed neck to insure a tight connection. As discussed in connection with FIG. 3, tool 20 is sized to permit its easy insertion into channel 17 and to permit the flow of material from the hopper into the channel where it is pneumatically conveyed through and out of the channel. Attachment means 28 is configured to fit snugly over the gasket so that the tool is held securely in place. A first gas line is connected to connecting means 30 and a second gas line is connected to connecting means 32. Flexible gas line 40 is connected to attachment means 28. The first and second gas lines and gas line 40 are connected to a source of pressurized gas and the flow of gas, e.g., air, started. A tubular flexible discharge line is connected to the exposed neck of channel 17 at its discharge end and connected to the storage vessel into which the bulk material is to be transferred. The gate or sliding valve regulating the flow of bulk material from the hopper into discharge channel 17 is opened. High pressure gas flowing through nozzles 36 in members 22 and 24 dislodge material that may tend to bridge across the discharge opening at the bottom of the hopper thereby permitting the continuous flow of dry material from the hopper into the discharge conduit. Carrier gas from gas line 40 flows through the annular space between the walls of attachment means 28 and the outside walls of members 22 and 24 and thence into channel 17 and into the discharge line, thereby to suspend pulverulent material in such carrier gas and transfer same to the storage vessel.

As will be appreciated by those skilled in the art, the present method and means may be used with various pulverulent materials transported in bulk in hopper-type vessels. Examples of such materials include silica-containing materials, such as amorphous precipitated silicas and sodium alumino silicate pigments, calcium carbonate, sodium carbonate and bicarbonate, titanium dioxide, sodium chloride, potassium chloride, cement, flour, grains, and other granular or powdery commodity materials having physical properties such as particle size, surface area, dispersibility in a carrier gas, and flowability to those possessed by the aforesaid silica-containing materials.

With respect to the gas pressure used in carrying out the described method, the pressure required for effecting efficient transfer of discharged material and for fluidizing same at the lateral discharge opening of the hopper may be readily determined by one skilled in the art. Generally, gas supply pressures in the range of from 40 to 100 pounds per square inch gage will be used.

With respect to the pressurized gas used in connection with the above-described method, any gaseous fluid that may be pressurized and that is compatible with the pulverulent material may be used. Commonly, pressurized air, which is readily available in most industrial plants, will be used. If necessary, chemically inert gases such as carbon dioxide and nitrogen may be used; however, such gases are economically unattractive for unloading of bulk cargo. Moreover, environmental concerns may dictate against the use of carrier and fluidizing gases other than air.

Although the present process has been described with reference to specific details of certain embodiments thereof, it is not intended that such details should be regarded as limitations upon the scope of the invention except as and to the extent they are included in the accompanying claims.

I claim:

1. A device for facilitating the removal by gravitational flow of dry pulverulent material from a hopper-type vessel, said vessel having an elongated lateral discharge opening in the bottom of the hopper and an elongated lateral discharge channel communicating with said lateral discharge opening, said channel having an inlet end and a discharge and, comprising elongated hollow member means that is insertable into the discharge channel, said elongated hollow member means having an inlet end and being closed at its distal end and being of a size such that when inserted into said discharge channel pulverulent material flows from the hopper through the discharge channel, orifice means in the elongated hollow member means for selectively directing the flow of a gaseous fluid in the direction of the lateral discharge opening at a rate of flow sufficient to prevent bridging of material in said discharge opening, means adjacent to the inlet end of the elongated hollow member means for attachment to the inlet end of the discharge channel, means for directing the flow of gaseous fluid through said elongated member means, and means for directing the flow of a gaseous fluid through said discharge channel toward the discharge end of said channel for transporting material falling into the channel toward the discharge end of the channel.

2. The device of claim 1 wherein the elongated hollow member is segmented.

3. The device of claim 2 wherein the elongated hollow member comprises two segments, each segment being rotatable around its longitudinal axis.

4. The device of claim 3 wherein the length of the first segment is from the attachment means to about the middle of the lateral discharge opening, and the length of the second segment is from the terminal end of the first segment to about the distal end of the lateral discharge opening.

5. The device of claim 1 wherein the elongated hollow member means and attachment means adjacent to the inlet end of the hollow member means define an annular space through which gaseous fluid may pass.

6. The device of claim 5 wherein the hollow member means passes through about the center of said attachment means.

7. The device of claim 6 wherein the attachment means comprises collar means which is attachable to the inlet end of the discharge channel.

8. The device of claim 1 wherein the elongated hollow member means includes two adjacent extended hollow conduits that are closed at their distal ends and open at their inlet ends, each conduit being attached to pressurized fluid gas supply means.

9. The device of claim 8 wherein the first of the adjacent conduits comprises an extended hollow conduit that has a length of from its inlet end to about the middle of the lateral discharge opening.

10. The device of claim 9 wherein the second of the adjacent conduits comprises an extended hollow conduit that has a first section having a longitudinal axis parallel to the first of the adjacent conduits, a second section having a longitudinal axis that when rigidly supported is coincident with the longitudinal axis of the first of the adjacent conduits, and an angled section connecting said first and second sections.

11. The device of claim 10 wherein the second section of the second of the adjacent conduits is rotatable around its longitudinal axis with respect to the first adjacent conduit.

12. The device of claim 10 wherein the first section of the second of the adjacent conduits is affixed to the first of the adjacent conduits.

13. The device of claim 10 wherein the attachment means comprises collar means adjacent to the inlet end of said two adjacent extended hollow conduits, said collar means and two adjacent conduits defining an annular space through which gaseous fluid may pass.

14. A method for removing dry pulverulent material from a hopper-type vessel containing said material while preventing bridging of the material therein, said vessel having a lateral discharge opening in the bottom of the hopper and an elongated discharge channel communicating with said lateral discharge opening, said discharge channel having an inlet end and a discharge end, comprising inserting into the inlet end of said discharge channel elongated hollow member means having a closed distal end, an inlet end, orifice means in the member for selectively directing the flow of gaseous fluid from the member at a rate of flow sufficient to prevent bridging of material in said discharge opening, a size that permits the downward flow by gravity of material from the hopper into the discharge channel, and attachment means adjacent to the inlet end of the hollow member means for attaching the hollow member means to the inlet of the discharge channel, positioning the member within the discharge channel so that the orifice means are pointing in the direction of the lateral discharge opening, connecting a source of pressurized gas to the inlet end of the elongated hollow member means, connecting a source of pressurized gas to means for directing the flow of gas through said discharge channel, causing dry pulverulent material to flow by gravity from the hopper through the lateral discharge opening and into the discharge channel, while simultaneously passing pressurized gas through said hollow member means and through said orifices in the direction of the lateral discharge opening, and passing pressurized gas through said discharge channel, thereby to transport pulverulent material falling into the discharge channel to the discharge end thereof.

15. The method of claim 14 wherein the pressurized gas is air.

16. The method of claim 15 wherein the material is an amorphous precipitated silica.

* * * * *